US005566647A

United States Patent [19]

Pascal

[11] Patent Number: 5,566,647

[45] Date of Patent: Oct. 22, 1996

[54] STEAM GENERATOR EQUIPPED WITH A DEVICE FOR TRAPPING MIGRATING BODIES

[75] Inventor: Yves Pascal, Nantene, France

[73] Assignee: Framatome, Paris, France

[21] Appl. No.: 245,669

[22] Filed: May 18, 1994

[30] Foreign Application Priority Data

May 27, 1993 [FR] France ..... 93 06372

[51] Int. Cl.[6] ..... F22B 1/02

[52] U.S. Cl. ..... 122/34; 122/488; 122/492

[58] Field of Search ..... 122/488, 489, 122/491, 492, 467, 34

[56] References Cited

U.S. PATENT DOCUMENTS

| | | | |
|---|---|---|---|
| 3,503,440 | 3/1970 | Romanos | 122/34 |
| 3,507,099 | 4/1970 | Marshall | 122/488 |
| 3,735,569 | 5/1973 | Micheller et al. | 122/34 |
| 3,906,905 | 9/1975 | Andrien et al. | 122/34 |
| 4,318,368 | 3/1982 | Carson et al. | 122/34 |
| 4,522,156 | 6/1985 | Chaix | 122/34 |
| 4,554,889 | 11/1985 | Lilly | 122/34 |
| 4,898,123 | 2/1990 | Holcblat | 122/492 |

FOREIGN PATENT DOCUMENTS

| | | |
|---|---|---|
| 183049 | 6/1986 | European Pat. Off. . |
| 2275731 | 1/1976 | France . |

*Primary Examiner*—Erick R. Solis

*Attorney, Agent, or Firm*—Pollock, Vande Sande & Priddy

[57] ABSTRACT

A device for trapping migrating bodies in nuclear power station steam generators or boilers is provided to prevent them from jamming between the generator tubes. The device, in the form of a grating or grid, is placed above a horizontal plate to which are fixed the upper ends of the pipes containing cyclone separators. It defines passages, whose largest dimensions are smaller than the minimum distance separating the tubes.

6 Claims, 2 Drawing Sheets

STEAM GENERATOR EQUIPPED WITH A DEVICE FOR TRAPPING MIGRATING BODIES

BACKGROUND OF THE INVENTION

The invention relates to a steam generator or boiler for use in a nuclear power station.

As is more particularly illustrated by FR-A-2 477 265, a steam generator equipping a nuclear power station conventionally comprises a vertically axed envelope, whose internal space is subdivided into two parts, by a horizontal plate, known as a tube sheet. The ends of the tubes of a bundle or nest of inverted U-tubes are fixed to the tube sheet and issue below the latter, respectively in an admission collector and a discharge collector for the water circulating in the primary circuit of the reactor, known as primary water. The water circulating in the secondary circuit of the reactor, known as secondary or feed water, is injected into the part of the steam generator located above the tube sheet. This feed water vaporizes on contact with the tubes as a result of the heat carried by the primary water. The resulting steam is extracted from the steam generator after successively traversing cyclone separators placed in substantially vertical pipes and then dryers located in the upper part of the envelope above the pipes containing the cyclone separators.

During installation or maintenance work on such a steam generator, it sometimes occurs that objects such as filler rods, screws, bolts, etc. are inadvertently introduced into the secondary circuit. It can also arise that objects-such as screws become detached during operation. When the feed water flows in the secondary circuit of the steam generator, all these objects constitute migrating bodies which may become jammed between the tubes of the bundle if they reach this part of the steam generator. This disturbs the flow of feed water and damages the tubes and can even lead to fracture thereof.

Part of the migrating bodies circulating in the secondary circuit of a steam generator comes from the feed water system and enters the steam generator by the feed water intake tube. Applicant's French Patent Application No. 91 14900 proposes a device making it possible to trap the migrating bodies introduced in this way into the steam generator.

Migrating bodies can also reach the nest of boiler tubes by pipes of the cyclone separators collecting the part where the tube nest is housed to the dryers. These migrating bodies coming from the area of the dryers are either objects such as screws which become detached from a dryer during operation, or objects introduced into the space between the upper plate of the cyclone separators and the dryers during an installation or maintenance intervention in the boiler, and inadvertently left behind in the latter. At present there is no device which is able to trap such migrating bodies, so that there is a risk of their falling to the bundle of tubes on passing through the substantially vertical pipes in which the cyclone separators are located.

SUMMARY OF THE INVENTION

The invention specifically relates to a steam generator having a device making it possible to trap the migrating bodies from the dryers, so that such bodies cannot jam between the tubes of the bundle.

According to the invention, this result is obtained by means of a steam generator comprising:

a vertically axed envelope, a horizontal tube sheet tightly fixed within the envelope, a bundle of inverted U-tubes, each having two ends fixed to the tube sheet and issuing below the latter, respectively into an admission collector and a discharge collector for the primary fluid, means for supplying secondary water issuing into the envelope above the horizontal tube sheet, and secondary steam extraction means placed in the envelope above the bundle of tubes and having substantially vertical discharge pipes placed below the drying means, the migrating body trapping means being placed between the pipes and the drying means, at least above each of the pipes.

In a preferred embodiment of the invention, the migrating body trapping means define passages which have a maximum dimension smaller than the minimum distance separating the tubes of the bundle.

The migrating body trapping means may occupy substantially the entire cross-section of the steam generator envelope, or they may only be located above each of the pipes.

More specifically, the migrating body trapping means preferably incorporate several trapping elements forming slabs, which may be square and which are placed above a horizontal plate or sheet to which are fixed the upper ends of the pipes.

Each trapping element can comprise a carrying structure forming a floor on which is placed a trapping grid or grating. This arrangement makes it possible to use the trapping means as the working floor during installation or maintenance work.

Each trapping element is advantageously fixed by dismantlable fixing means, which preferably cannot be lost, such as bolts, to horizontal joists which are fixed above the horizontal sheet and outlets of the separators.

BRIEF DESCRIPTION OF THE DRAWINGS

An embodiment of the invention will now be described in greater detail and with reference to the attached drawings.

DETAILED DESCRIPTION

Figure 1:
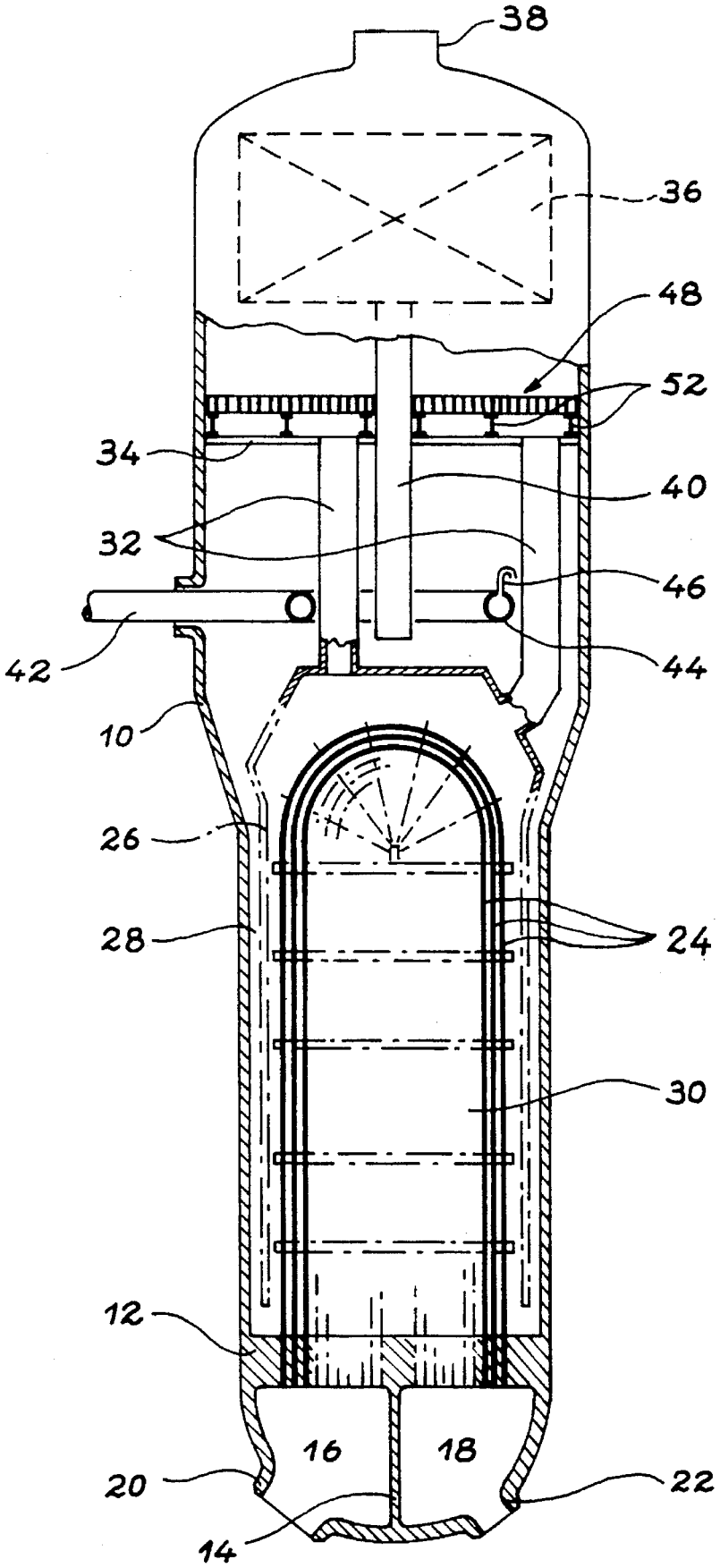
FIG. 1 is a vertical sectional view schematically illustrating a steam generator according to the invention.

FIG. 1 shows the vertically axed, external revolution envelope 10 of a steam generator or boiler for ensuring the heat transfer between the primary water circuit and the secondary water/steam circuit of a pressurized water nuclear reactor. The envelope 10 defines a closed internal space, which is subdivided into a primary, lower zone and a secondary, upper zone by a horizontal tube sheet 12 tightly connected to the envelope 10.

A vertical partition 14 subdivides the primary, lower zone, normally known as the water box, into an admission collector 16 and a discharge collector 18 for the water circulating in the primary circuit of the reactor. Tubes 20 and 22, welded to the outer envelope 20 of the steam generator, respectively connect the collectors 16 and 18 to the primary circuit.

A bundle of inverted U-tubes 24 is tightly connected to the tube sheet 12 in the secondary, upper zone defined by the latter. More specifically, the two ends of each of the tubes 24 respectively issue into the admission collector 16 and into the discharge collector 18. Thus, the primary water admitted into the steam generator by means of the admission collector 16 circulates in the tubes 24 before leaving the apparatus by the discharge collector 18.

The tube bundle 24 is surrounded and covered by an inner envelope 26 arranged coaxially in the outer envelope 10. The lower edge of the inner envelope 26 is placed at a given distance above the tube sheet 12, so as to form a passage by which an annular space, defined between the envelopes 10 and 26, communicates with a space 30 within the envelope 26.

In the embodiment illustrated in FIG. 1, the feed water is introduced into the steam generator by a supply pipe 42, which radially traverses the outer envelope 10 at a level close to the upper part of the inner envelope 26 covering the tube bundle 24. This supply pipe 42 issues into a toroidal collector 44 centered on the vertical axis of the steam generator and provided over its entire periphery with inverted J-shaped tubes 46 by which the feed water is injected into the top of the annular space 28.

It should be noted that the invention applies to steam generators having different structures, and in particular to those in which the feed water is introduced directly into the annular space 28 in the vicinity of the tube sheet 12.

Substantially vertical discharge pipes 32 are connected by their lower end to the upper part of the inner envelope 26, which covers the tube bundle 24. The upper end of these discharge pipes 32 is welded to a horizontal plate 34, whose peripheral edge is supported by the outer envelope 10 of the steam generator. Cyclone or centrifugal separators (not shown) are located in each of the discharge pipes 32, in order to trap part of the water entrained by the steam in order to recycle it to the lower part of the steam generator. These cyclone or centrifugal separators are normally constituted by fixed, helically shaped blades located in the discharge pipes 32.

The steam entering the upper part of the outer envelope 10 by the discharge pipes 32 then traverses the dryers 36 placed at a certain distance above the horizontal plate 34 before passing out of the steam generator by a secondary steam extraction tube 38 located at the top of the outer envelope 10, coaxially with the vertical axis of the steam generator. The dryers 36, which can have different shapes, constitute a group of baffles which must be traversed by the steam before leaving the steam generator. These baffles help to dry the steam by recycling part of the water entrained by the latter. The thus recovered recycling water, which is generally referred to as recirculation water, is brought to the lower part of the steam generator by at least one substantially vertical pipe 40, which traverses the horizontal plate 34 and whose lower end is located above the upper part of the inner envelope 26 covering the tube bundle 24.

According to the invention, means 48 for trapping migrating bodies coming from the dryers 36 are provided above the horizontal plate 34. The migrating body trapping means 48 mainly serve to hold back objects accidentally dropping from the dryers 36, so as to ensure that these do not jam between the tubes 24 after traversing the discharge pipes 32. The objects which may drop from the dryers 36 can either have been inadvertently left behind in the dryers following the installation of the steam generator or during subsequent interventions, or have accidentally become detached from the dryers in operation, such as screws. The trapping means also hold back objects which may accidentally drop during the intervention into the upper part of the steam generator.

The migrating body trapping means 48 can also form, within the upper part of the steam generator, a working floor facilitating interventions both during steam generator installation work and during maintenance operations.

Finally, the migrating body trapping means 48 can also help to improve the efficiency of the dryers 36, by interrupting the rotary movements of the steam on leaving the cyclone separators located in the discharge pipes 32.

However, the two latter functions are optional.

In the embodiment illustrated in FIG. 1, the migrating body trapping means 48 occupy virtually the entire cross-section of the steam generator or boiler above the horizontal plate 34. In view of the fact that the migrating bodies can only redescend towards the tubes 24 of the bundle through the discharge pipes 32, the trapping means can also have a reduced cross-section and can optionally be formed from separate assemblies placed in the upper part of each of the discharge pipes 32. However, it is clear that the migrating body trapping means 48 can only constitute an effective working floor if they occupy most of the steam generator cross-section, as illustrated in FIG. 1.

In order that the means 48 can effectively fulfil their function of trapping migrating bodies, they are advantageously in the form of a grating, which has a structure opposing to the minimum possible extent the escape of steam towards the tube 38, while still reliably retaining objects whose size creates a risk of their jamming between the tubes 24 of the bundle, if they enter the area 30 within the envelope 26.

Specifically, this result is achieved by providing meshes defined by the grating forming the migrating body trapping means 48 with a maximum size smaller than minimum distance separating the tubes 24 of the bundle.

Figure 2:
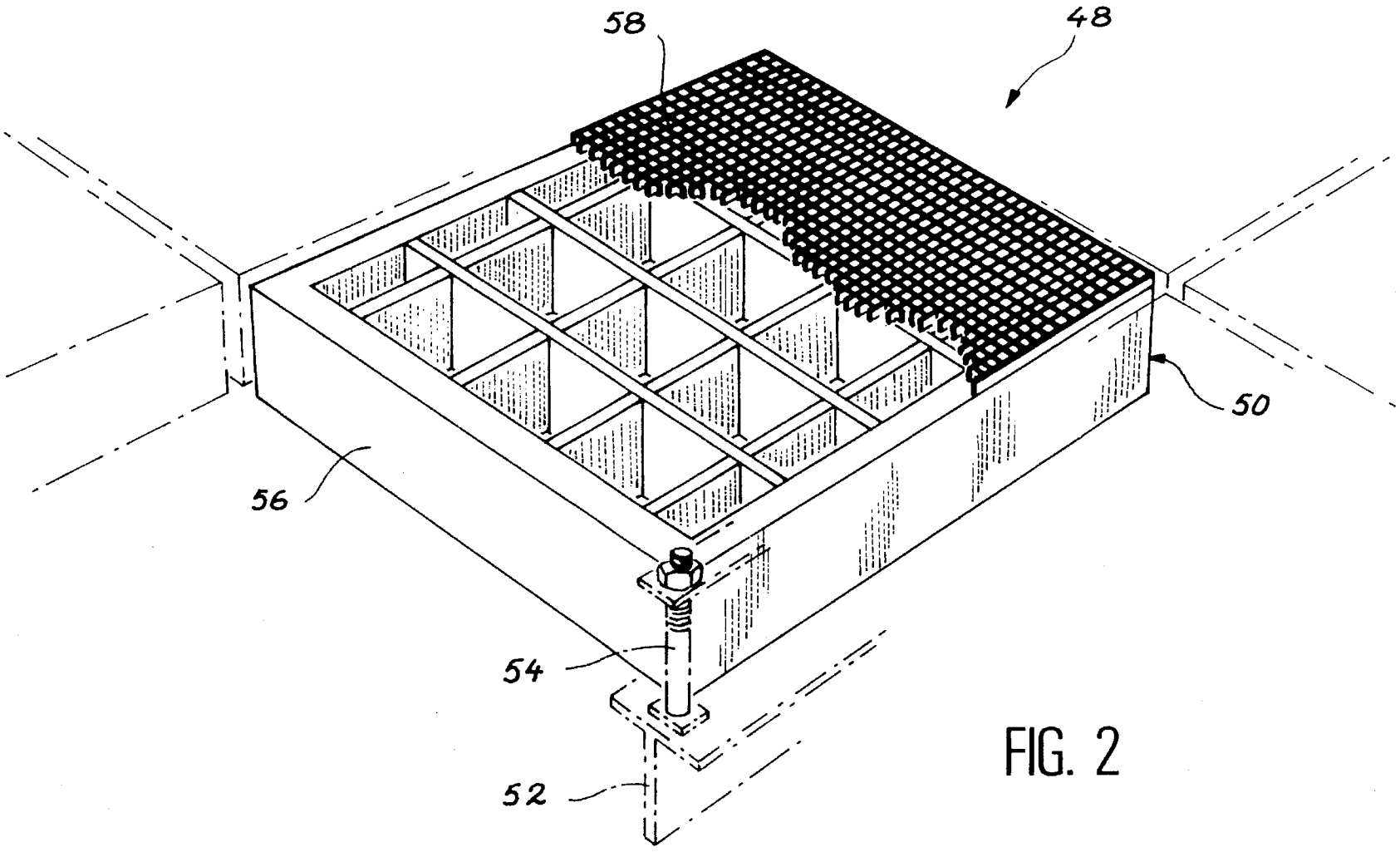
FIG. 2 is a perspective plan view showing one of the trapping elements used according to the invention in the steam generator illustrated in FIG. 1.

In practice, the migrating body trapping means 48 are advantageously formed by juxtaposing several trapping elements, such as the element 50 in FIG. 2. Each element 50 is then in the form of an e.g., square slab, which rests on the horizontal plate 34 by means of joists 52. The ends of joists 52 then bear on the outer envelope 10 of the steam generator, in order to give the structure sufficient rigidity to form a floor able to support one or more persons during maintenance or installation work.

Each of the trapping elements 50 is advantageously fixed in dismantlable manner to the joists 52, e.g., with the aid of screws or studs 54, which preferably cannot be lost.

In the embodiment shown in FIG. 2, each trapping element 50 is formed by a carrying or bearing structure 56 forming a floor and a trapping grating 58 resting on the structure 56. More specifically, the carrying structure 56 is constituted by a frame in which is fixed a wide-meshed grating giving the structure 56 adequate mechanical strength for it to support the weight of the intervention personnel.

The trapping grating 58 traps the migrating bodies. To this end it has a mesh defining passages whose maximum size is smaller than the minimum distance separating the tubes 24 of the bundle. In the embodiment illustrated in FIG. 2, the grating 58 has inadequate mechanical characteristics for supporting personnel having to intervene in the steam generator.

When the migrating body trapping means 48 occupy virtually the entire cross-section of the steam generator, as illustrated in FIG. 1, the trapping elements 50 are fixed edge to edge in order to form a tiled floor, in the manner schematically illustrated in FIG. 2.

When the migrating body trapping means 48 occupy only part of the cross-section of the steam generator, one or more trapping elements 50 can be placed above each of the discharge pipes 32. In particular, it is possible to place a circular trapping element in the top of each of the discharge pipes 32.

The embodiment described relative to FIG. 2 only constitutes an example of the invention. Thus, the migrating body trapping means 48 can also be in one piece over all or part of the cross-section of the steam generator. Moreover, when separate trapping elements are used, these can have a random shapes. The structure ensuring the trapping of the migrating bodies can also have an adequate mechanical strength to obviate the addition of a carrying or bearing structure. Finally, the shape of the passages and the structure defining them is not limited to a grating, but instead covers all shapes and structures making it possible to define passages having limited dimensions (circular, triangular, polygonal and similar passages, structures obtained by the assembly of plates, rods, etc., or by machining a solid part, etc.).

I claim:

1. A steam generator comprising:

(a) a vertically axed outer envelope;

(b) a horizontal tube sheet tightly fixed within the outer envelope;

(c) a bundle of inverted U-tubes, each having two ends fixed to the tube sheet and respectively issuing below the tube sheet into an admission collector and a discharge collector for the primary fluid;

(d) means for supplying secondary water issuing into the outer envelope above the tube sheet;

(e) an inner envelope covering the bundle of tubes;

(f) substantially vertical discharge pipes extending upwards from an upper part of the inner envelope;

(g) drying means placed in the outer envelope at a distance above upper ends of the discharge pipes; and (h) secondary steam extraction means located at a top of the outer envelope; and (i) migrating body trapping means located in the outer envelope, at an intermediate level between upper ends of the discharge pipes and the drying means, said trapping means being located at least above each discharge pipe and defining passages having a maximum dimension smaller than a minimum distance separating the tubes of the bundle.

2. The steam generator according to claim 1, wherein the migrating body trapping means occupy substantially an entire cross-section of the envelope.

3. The steam generator according to claim 1, wherein the migrating body trapping means are located above each of the discharge pipes.

4. The steam generator according to claim 1, wherein the migrating body trapping means incorporate several trapping elements placed above a horizontal plate to which are fixed upper ends of the discharge pipes.

5. The steam generator according to claim 4, wherein each trapping element incorporates a carrying structure forming a floor, on which is placed a trapping grating.

6. The steam generator according to claim 4, wherein each trapping element is fixed by dismantlable fixing means to horizontal joists located above said horizontal plate.

* * * * *